United States Patent [19]

Ferro

[11] 4,233,541

[45] Nov. 11, 1980

[54] START WINDING FOR SOLENOIDAL ELECTRIC FIELD DISCHARGE LAMPS

[75] Inventor: Armand P. Ferro, Schenectady, N.Y.

[73] Assignee: General Electric Company, Schenectady, N.Y.

[21] Appl. No.: 42,217

[22] Filed: May 24, 1979

[51] Int. Cl.[3] ..... H01J 11/00; H01J 65/04

[52] U.S. Cl. ..... 315/70; 315/248

[58] Field of Search ..... 315/70, 248, 57

[56] References Cited

U.S. PATENT DOCUMENTS

| | | | |
|---|---|---|---|
| 2,015,885 | 10/1935 | Dallenbach | 315/248 X |
| 2,223,399 | 12/1940 | Bethenod | 315/248 X |
| 4,005,330 | 1/1977 | Glascock, Jr. et al. | 315/57 |
| 4,017,764 | 4/1977 | Anderson | 315/248 |

*Primary Examiner*—Alfred E. Smith
*Assistant Examiner*—Charles F. Roberts
*Attorney, Agent, or Firm*—Alexander M. Gerasimow; Marvin Snyder; James C. Davis

[57] ABSTRACT

Efficient starting of solenoidal electric field discharge lamps is effected with a start winding disposed on the same core with the ballast reactance. This placement of the start winding possesses certain advantages over other methods of lamp starting, and in particular it facilitates hot restart of the lamp.

8 Claims, 5 Drawing Figures

START WINDING FOR SOLENOIDAL ELECTRIC FIELD DISCHARGE LAMPS

BACKGROUND OF THE INVENTION

This invention relates to solenoidal electric field (SEF) lamps, and in particular to circuitry for initiating lamp operation.

U.S. Pat. No. 4,005,330 to Homer H. Glascock, Jr. and John M. Anderson and U.S. Pat. No. 4,017,764 to John M. Anderson describe a class of induction ionized flourescent lamps wherein a high frequency, solenoidal electric field is established by a lamp core having a torodial shape which is centrally disposed with respect to a substantially globular envelope. The lamps described in these patents may be manufactured in a form which is electrically and mechanically compatible with the common Edison base incandescent lamp and which provides substantially more efficient operation than conventional incandescent lamps. The above Glascock and Anderson patents are hereby incorporated herein as background material.

In such SEF lamps, an annular core typically comprising ferrite is disposed within or about an ionizable gas such as mercury vapor. This annular core possesses an electrical winding for coupling to a radio frequency energy source. The electrical energy being supplied to this core winding creates a solenoidal electric field within the ionizable medium of sufficient strength to produce current flow in the plasma, once plasma ionization occurs. The plasma ionization and subsequent current flow produces electromagnetic radiation at a first frequency through electron transition in the medium. Typically, when the ionizable medium comprises mercury as a major portion, the electromagnetic radiation lies in the ultraviolet region of the spectrum. In the typical case, ultraviolet radiation per se is not the optical output desired and the envelope containing the ionizable medium is conventionally coated with a phosphor which absorbs energy at the first frequency and reradiates electromagnetic energy at a second, optical frequency or frequencies depending upon the combination of phosphors employed.

The SEF lamp has two major portions associated therewith. First there is the envelope portion itself typically comprising an envelope, one or more toroidal ferrite cores with windings thereon and an ionizable fill gas contained in the envelope which typically possesses an internal phosphor coating. The SEF lamp also comprises a ballast portion which operates to convert conventional line current to higher frequency voltage pulses which are more efficient for lamp operation. Push-pull inverter circuits with appropriate control modalities are particularly useful for supplying the desired voltage pulses. Because the ionizable medium has a negative resistance characteristic, it is necessary to electrically couple the core winding to the ballast circuit through one or more ballast reactances to limit the current flow following plasma ionization during which the effective resistance of the plasma decreases. Thus, the lamp core operates in a transformer, the primary winding of which being the core winding connected to the ballast circuit, the secondary of which being the single turn of current flow through the plasma along the lines of the solenodial electric field.

Before the lamp enters into the negative resistance portion of its operating curve, it is first necessary to initially ionize a portion of the plasma to effect easy lamp starting. While it is possible to effect lamp starting simply by providing greater energy input into the core winding in a short period of time, this method of lamp starting is undesirable since it produces an unnecessary level of core heating thereby increasing the possibility that the Curie temperature of the ferrite core is exceeded and this method also results in undesirable levels of noise from the lamp components. Another method of accomplishing lamp starting is to dispose an additional winding or windings on the lamp core. The starting winding on the core may comprise a second separate winding, but this is not preferred. Alternately, the start winding may be disposed on the core and configured with the primary winding on the core so as to operate as an autotransformer as disclosed in application Ser. No. 799,300 filed May 23, 1977 in the name of Loren H. Walker and the inventor herein which invention is assigned to the same assignee as the present invention. However, because of the relatively high temperature at which the core operates, particularly in an SEF lamp configuration in which the core is disposed within the ionizable medium itself, it is necessary to provide expensive high temperature insulation for the additional turns required on the core.

SUMMARY OF THE INVENTION

In accordance with a preferred embodiment of the present invention, the start winding for an SEF lamp is disposed on the ballast reactor core and configured in an autotransformer circuit so as to provide a high starting voltage to a starting electrode disposed either within or on the outside of the lamp envelope. Thus, starting voltages applied to initiate plasma ionization do not cause heating of the lamp core. Since it is highly desirable to provide a core for the ballast reactance or for an impedance matching transformer, it is easy to include an extra winding on such a core to provide the necessary starting voltage. With the start winding disposed on the ballast reactance core, it is no longer necessary to provide the high temperature insulation needed if the winding is disposed on the lamp core itself. Additionally, hot restart of the lamp is also facilitated with the placement of the winding on a ballast core.

Accordingly, it is an object of the present invention to provide means for starting a solenoidal electric field lamp which facilitates hot starting, avoids the need for high temperature insulation, and does not increase the cost of lamp manufacture.

DETAILED DESCRIPTION OF THE INVENTION

Figure 1:
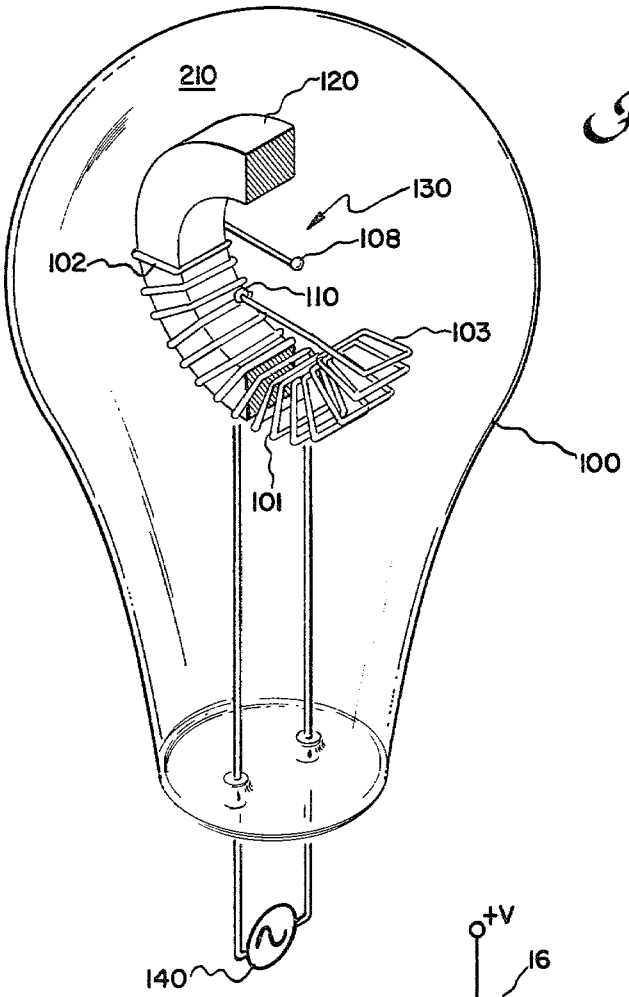
FIG. 1 is a perspective view illustrating a start winding disposed on the lamp core.

FIG. 1 shows the lamp portion of a conventional solenoidal field lamp not incorporating the present invention, the ballast portion being indicated by radio frequency energy source 140. The lamp comprises envelope 100 containing an ionizable medium 210 such as mercury vapor or mercury vapor mixed with inert gases such as argon or krypton. Disposed within the ionizable medium is core 120 typically comprising ferrite. The toroidal lamp core 120 has a tunnel portion 130 through which windings 101, 102, and 103 are disposed as shown. Winding portion 101 acts as the lamp primary, the lamp secondary being the current loop through the ionizable medium. In addition to primary winding portion 101 there is also disposed winding portions 102 and 103 also placed on core 120 and connected with winding portion 101 so as to act as an autotransformer for inducing high voltage pulses so as to create a high potential difference between electrodes 108 and 110 which are preferably disposed along the central axis of the toroid 120. The envelope 100 typically comprises a light-transmissive evacuable envelope such as glass and is preferably coated with a light converting phosphor. As described above, the placement of the start winding in this fashion has the disadvantage that hot restarts unnecessarily heat the lamp core 120 since the start winding is disposed directly on it.

Figure 2:
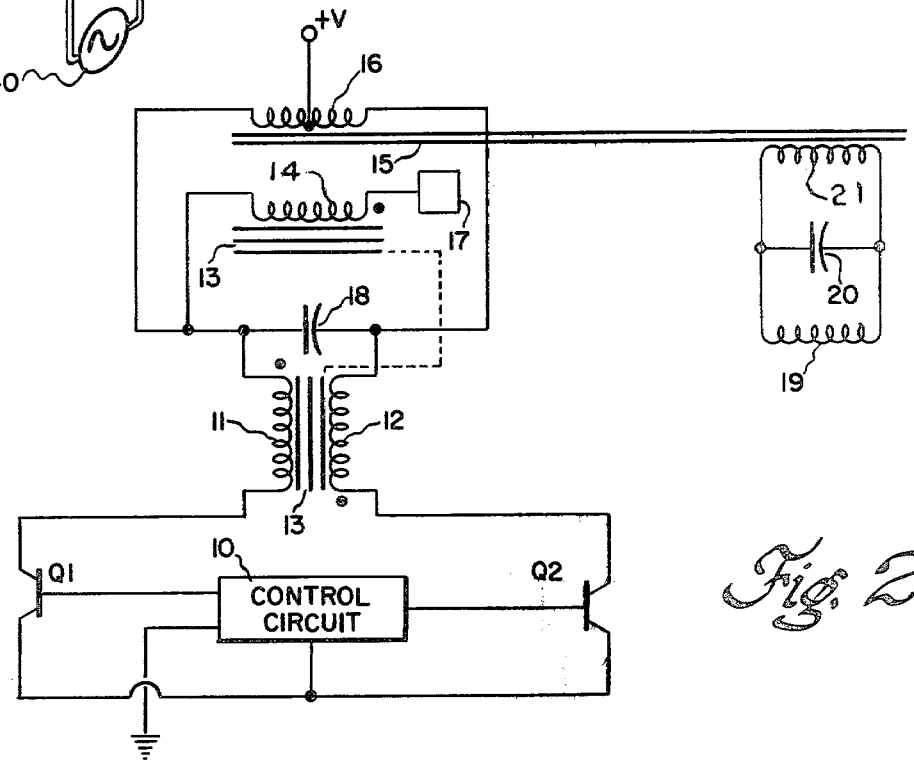
FIG. 2 is a circuit in accordance with the present invention illustrating the placement of the start winding on the ballast reactance core.
Figure 4:
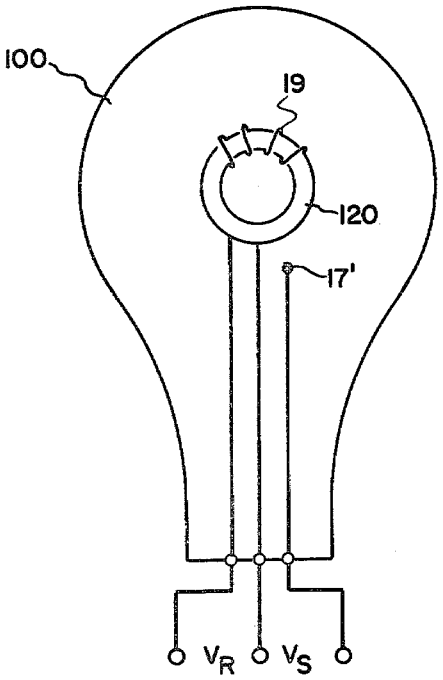
FIG. 4 is a schematic diagram illustrating internal starting electrode placement.
Figure 5:
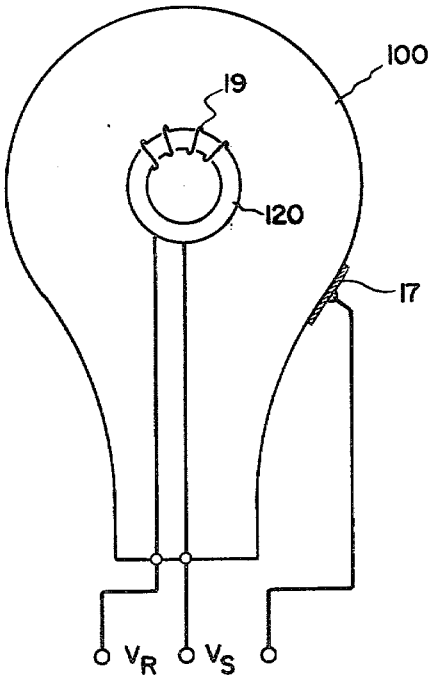
FIG. 5 is a schematic diagram illustrating external starting electrode placement.

FIG. 2 illustrates one embodiment of the present invention in which the ballast circuit includes a start winding contained on the same core as the ballast reactance. In particular, start winding 14 is disposed on the same core as ballast reactances 11 and 12, as indicated by the dotted line between the core portions. As indicated by the dot convention as shown, winding 14 is wound in the same direction as winding 11 so as voltages produced in these coils are in phase and reinforce in the fashion which typically occurs in autotransformers. Obviously, because of the symmetry of the circuit, the start winding could just as easily be connected to the "high" side of coil 12 if its winding direction is reversed so as to match that of coil 12. Coils 11 and 12 operate as ballast reactances limiting the current in the plasma discharge. Coils 11 and 12 are disposed in opposed phase relationship as shown by the dots and their "low" sides are each connected respectively to transistors Q1 and Q2 operating as the switches in a push-pull inverter circuit. These transistors are alternately switched on and off in response to control circuit 10 which may be responsive to such control variables as peak current or the time rate of change of current. Resonance capacitor 18 may be connected between the high sides of the ballast reactances as shown to further facilitate starting. Starting electrode 17 may be disposed in a convenient location at the outer surface of the envelope of an SEF lamp as shown in FIG. 5. However, although it is not as preferable, the starting electrode may actually be disposed within the envelope itself, as shown in FIG. 4, rather than along an outside wall of the envelope. Such an electrode 17' preferably comprises a coated conductive lead having an exposed tip as shown in FIG. 4. The current flow which transistors Q1 and Q1 control is supplied through a center tap on coil 16 having a core 15. Thus, winding 16, core 15, and winding 21 on core 15 operate as a matching transformer coupling power to coil 19 which is disposed on the lamp core. Thus, winding 19 in FIG. 2 corresponds to winding portion 101 in FIG. 1. Impedance matching may also be facilitated, if desired, through the use of capacitor 20 which is conventionally located with the ballast circuitry. It is also to be noted that cores 13 and 15 may conveniently comprise a single magnetic structure.

Since between approximately 700 and approximately 900 volts peak potential is required to adequately start most lamps in normal conditions, an adequate number of turns must be employed in coil 14. By way of example, and not limitation for SEF lamps of the present design, coil 14 may comprise approximately 30 or 40 turns of very thin wire. In contrast, if the start winding is disposed on the lamp core itself, even if fewer turns of wire are required, the wire must have a greater diameter since it is most conveniently derived from the same high current primary winding. Additionally, if the start winding is disposed on the lamp core itself, additional insulation is required to protect it from the high temperature developed within the lamp itself.

Figure 3:
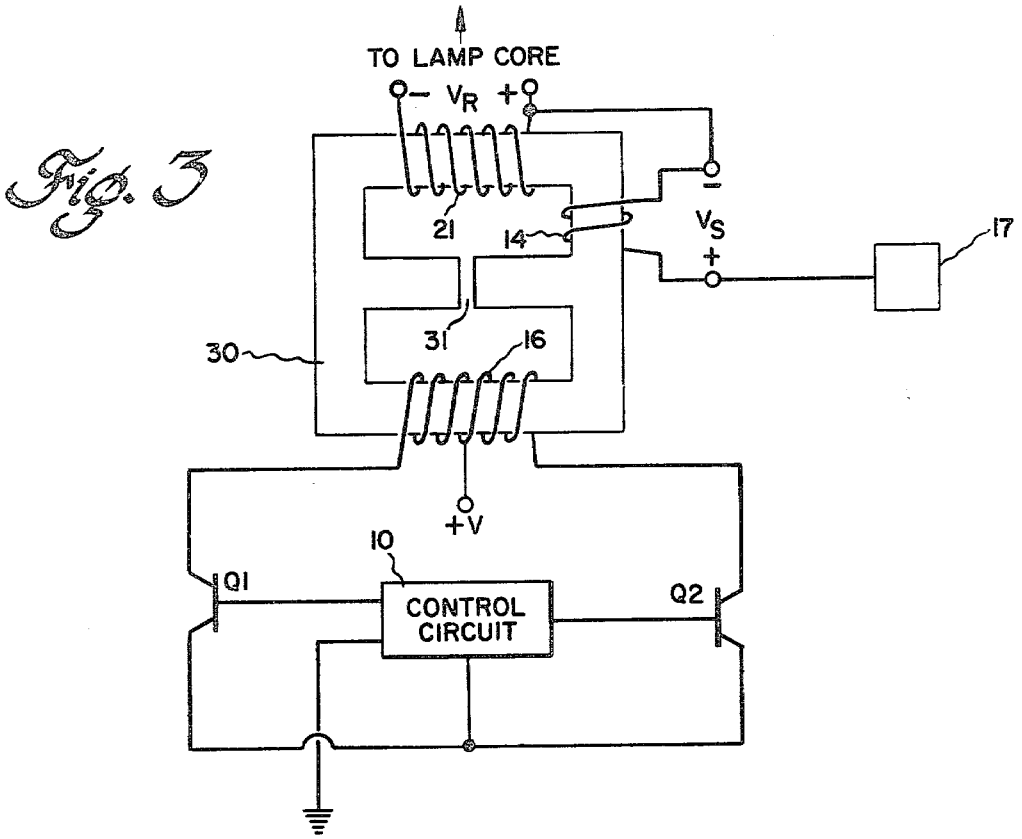
FIG. 3 is an alternate embodiment of the circuit shown in FIG. 2.

FIG. 3 illustrates an alternate embodiment of the present invention in which a single magnetic core structure 30 is employed as shown. This configuration has the added advantage of simplicity in that the ballast reactance provided by coils 11 and 12 in FIG. 2 is now simply provided by the gap 31 in the middle leg of core 30.

However, in either FIG. 3 or FIG. 4, placement of the start winding in series on the ballast magnetic core significantly increases the starting efficiency since the start winding 14 is now subjected to greater volts/turn which promotes easier, more efficient lamp starting. Higher energy levels are supplied to the start winding by resonating the start winding by raising the pulse frequency which is determined by control circuit 10. After lamp start, the pulse frequency may be reduced to resonate with the lamp core inductance.

Accordingly, from the above, it may be appreciated that the present invention provides a convenient and inexpensive starting circuit for a solenoidal electric field lamp. Additionally, it is seen that the present invention results in a saving of insulation cost, and more significantly, it improves the hot restart characteristics of SEF lamps.

While this invention has been described with reference to particular embodiments and examples, other modifications and variations will occur to those skilled in the art in view of the above teachings. Accordingly, it should be understood that within the scope of the appended claims the invention may be practiced otherwise than is specifically described.

The invention claimed is:

1. A solenoidal electric field lamp apparatus comprising:

a light-transmissive evacuable envelope containing an ionizable gaseous medium and having a phosphor disposed on said envelope for absorption of electromagnetic radiation at a first optical frequency from said medium and reradiation of electromagnetic radiation at a second optical frequency;

a magnetic lamp core electromagnetically coupled to said medium, said core having a conductive winding thereon;

an electronic ballast circuit for supplying radio frequency energy;

means for providing ballast reactance for said ballast circuit;

a transformer having a core, a primary winding electromagnetically coupled to said ballast circuit and a secondary winding coupled to said lamp core; and a start winding disposed on a magnetic core and connected to act as an autotransformer with said transformer secondary winding and being futher connected to a starting electrode disposed proximal to said gaseous medium.

2. The solenoidal electric field lamp device of claim 1 in which said lamp core is disposed within said gaseous medium.

3. The lamp apparatus of claim 1 in which said starting electrode comprises an electrically conductive pad disposed adjacent to the exterior of said envelope.

4. The lamp apparatus of claim 1 in which said starting electrode comprises a coated conductive lead with an exposed tip being disposed within said gaseous medium.

5. The lamp apparatus of claim 1 in which said ballast reactance means comprises a pair of opposed, electromagnetically coupled coils.

6. The lamp apparatus of claim 1 in which said ballast reactance means comprises a multilegged magnetic core with at least one leg possessing an air gap therein for providing leakage reactance.

7. The lamp apparatus of claim 1 in which said transformer core and said ballast reactance means share a common magnetic core structure.

8. The lamp apparatus of claim 7 in which said start winding also shares the common magnetic core structure.

* * * * *